US006598609B2

(12) United States Patent
Gibbs

(10) Patent No.: US 6,598,609 B2
(45) Date of Patent: Jul. 29, 2003

(54) SHAVING KIT HOLDER

(76) Inventor: James Matthews Irving Gibbs, 697-22-03 Desa Kiara Condominium, Jalan Damansara, 60000 Petaling Jaya, Selangor Darul Ehsan (MY)

( * ) Notice: Subject to any disclaimer, the term of this patent is extended or adjusted under 35 U.S.C. 154(b) by 0 days.

(21) Appl. No.: 10/009,623

(22) PCT Filed: Feb. 5, 2001

(86) PCT No.: PCT/IB01/00146

§ 371 (c)(1),
(2), (4) Date: Dec. 11, 2001

(87) PCT Pub. No.: WO01/60198

PCT Pub. Date: Aug. 23, 2001

(65) Prior Publication Data

US 2002/0157683 A1 Oct. 31, 2002

(30) Foreign Application Priority Data

Feb. 15, 2000 (MY) ..... PI 20000541

(51) Int. Cl.[7] ..... A45D 27/22
(52) U.S. Cl. ..... 132/289
(58) Field of Search ..... 132/289, 286, 132/292, 290; 206/228, 229, 581, 823, 235

(56) References Cited

U.S. PATENT DOCUMENTS

| | | | | |
|---|---|---|---|---|
| 1,887,124 A | | 11/1932 | Flintermann | |
| 4,141,445 A | * | 2/1979 | Korich | 206/228 |
| 4,232,785 A | * | 11/1980 | Lucas | 206/228 |
| 4,320,832 A | | 3/1982 | Edstrom | 206/228 |
| 4,768,530 A | * | 9/1988 | Vaghn | 132/289 |
| 5,738,122 A | | 4/1998 | Armbruster et al. | 132/290 |
| 6,006,760 A | * | 12/1999 | Benzinger | 132/286 |

FOREIGN PATENT DOCUMENTS

| | | |
|---|---|---|
| FR | 2641954 | 7/1990 |
| FR | 2733884 | 11/1996 |
| GB | 2129682 | 5/1984 |

* cited by examiner

*Primary Examiner*—John J. Wilson
*Assistant Examiner*—Robyn Kieu Doan
(74) *Attorney, Agent, or Firm*—Webb Ziesenheim Logsdon Orkin & Hanson, P.C.

(57) ABSTRACT

A device for holding a kit of items used for wet shaving has a razor-receiving section for storing a razor in an upright manner with the blade head protectively located, and a container-receiving section for storing a can of shaving foam or gel. The body of the holder has an internal storage space for storing one or more replacement blade cartridges, and a miniature mirror is removably and reversibly fitted in the base of the device.

12 Claims, 5 Drawing Sheets

SHAVING KIT HOLDER

FIELD OF THE INVENTION

This invention relates generally to the field of wet shaving and, more specifically, to a holder for a kit of items used for wet shaving.

BACKGROUND OF THE INVENTION

Particularly when travelling, shavers frequently find that with modem razors the blade-holding cartridge becomes detached from the razor handle in their toilet bag or suitcase. As a result, the blade(s) can become blunted by contact with other articles. Moreover, when the user wishes to remove the cartridge or the razor from the bag, there is a risk of cutting the fingers.

Replacement blade cartridges are also often lost or misplaced when travelling and similarly carry the risk of causing injury or the inconvenience of becoming blunted prior to use.

Another problem is that, with some cans of shaving foam or gel, a lacquer coating on the metal can easily becomes chipped around the bottom rim. Therefore, when the can is stood on a bathroom shelf or the like in a damp environment, a ring of rust forms. This can be very difficult to remove, especially if the can is allowed to stand for a long time.

SUMMARY OF THE INVENTION

The present invention was developed in consideration of the above problems and so aims to provide a convenient, safe and secure holder for storing shaving kit. In particular, the kit includes a razor, a container of shaving aid substance, typically a can of foam or gel, and optionally, one or more replacement blade cartridges.

In accordance with the invention, a shaving kit holder is provided for holding a kit of items used for wet shaving, the holder comprising a body having a base that allows the holder to be stood on a generally flat surface, the body including a razor-receiving section for holding a razor such that the blade or blades of the razor head are protectively located, and the body further including a container-receiving section for holding a container of shaving aid substance in a substantially upright disposition, wherein the container-receiving section includes a portion of the base that extends at least partially under the bottom of the container, such that the container is isolated from the generally flat surface.

In a preferred embodiment, the body includes an internal space adapted for storing at least one replacement blade cartridge for the razor, the space being closed off by the container when the container is located in the container-receiving section. This space may accommodate individual cartridges or a cassette in which several cartridges can be stored.

Preferably, the razor-receiving section includes a first lower cavity in which one end of the razor handle is seated, and an upper cavity in which the razor head is located.

The upper cavity may be defined partially by a cover that is movable between an open position permitting insertion and removal of the razor and a closed position in which the razor is locked in the razor-receiving section. This cover prevents the razor head from becoming accidentally released from the handle, and also protects against damage and injury.

Alternatively, or additionally, the razor-receiving section may include a resilient clip for clamping the razor handle.

The resilience of the clip is ideally such that the razor is held securely in place, yet can be removed and inserted with relatively light finger pressure.

Preferably, the first lower cavity includes at least one drainage hole to prevent liquid accumulating therein.

Preferably, the container-receiving section includes a second lower cavity defined by an annular wall having an internal ledge for receiving and holding the bottom of the container, thereby isolating the container bottom from the surface on which the holder is stood.

Preferably, the container-receiving section includes an upper retaining ring, either continuous or open, that supports the body of the container.

The second lower cavity preferably includes at least one drainage hole to prevent liquid accumulating therein.

In one embodiment, the holder body includes an aperture that permits finger access therethrough to a substance release button on the container, whereby the container may be used to eject foam or gel without removal from the container-receiving section.

Advantageously, the holder further includes a mirror that is adapted to be removably attached to the body of the holder. Preferably, the mirror is adapted to be stored by fitting, e.g. by means of a snap-lock, in the base of the holder. The mirror may fit in the base in a reversible manner, so that the mirror faces either internally or externally.

BRIEF DESCRIPTION OF THE DRAWINGS

The invention is illustrated, but not limited, by the following description of embodiments, given by way of example only, with reference to the accompanying drawings in which.

DETAILED DESCRIPTION OF THE EMBODIMENTS

As shown in FIGS. 1 to 5, the shaving kit holder of the first embodiment comprises a body 1 suitably made of moulded plastics material. The body 1 is of generally hollow, thin-walled construction and comprises a support portion that is upstanding with respect to a base portion 2. The base portion 2 allows the holder to be stood on a generally flat surface, such as a bathroom shelf or washbasin surround. In this embodiment, the base portion 2 includes a base piece that is arranged to snapfit into the main body of the holder, as shown in the exploded view of FIG. 2, although it could alternatively be made integral with the main body. The body 1 has a razor-receiving section 3 and a container-receiving section 4, these two sections being arranged at opposed positions on the holder.

Figure 1:
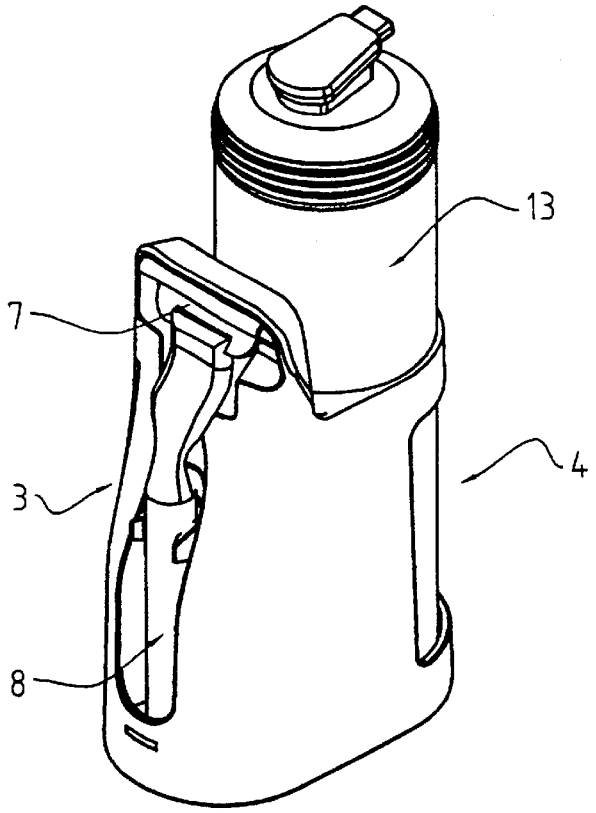
FIG. 1 is a perspective pictorial view of a shaving kit holder in accordance with a first embodiment of the invention, and showing the holder in use.
Figure 2:
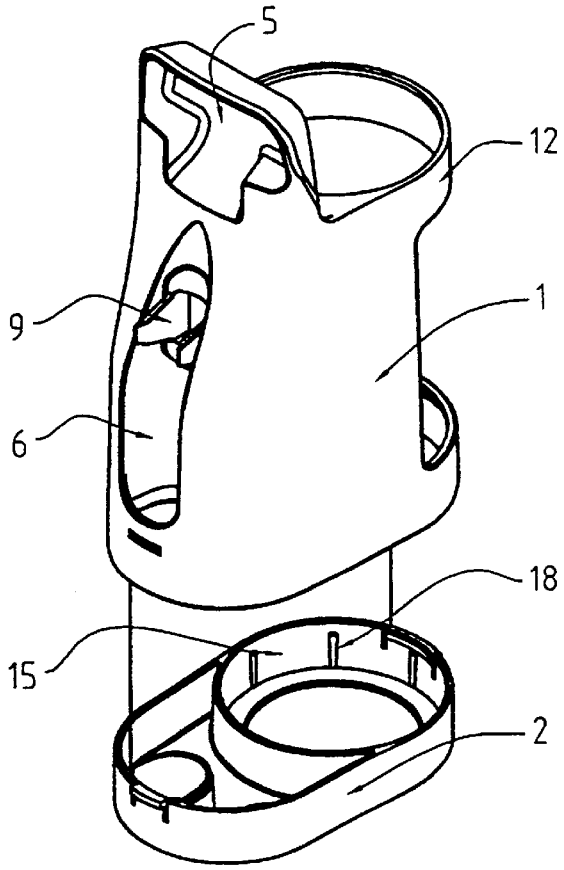
FIG. 2 is a perspective of the holder of FIG. 1, minus the items of shaving kit.
Figure 3:
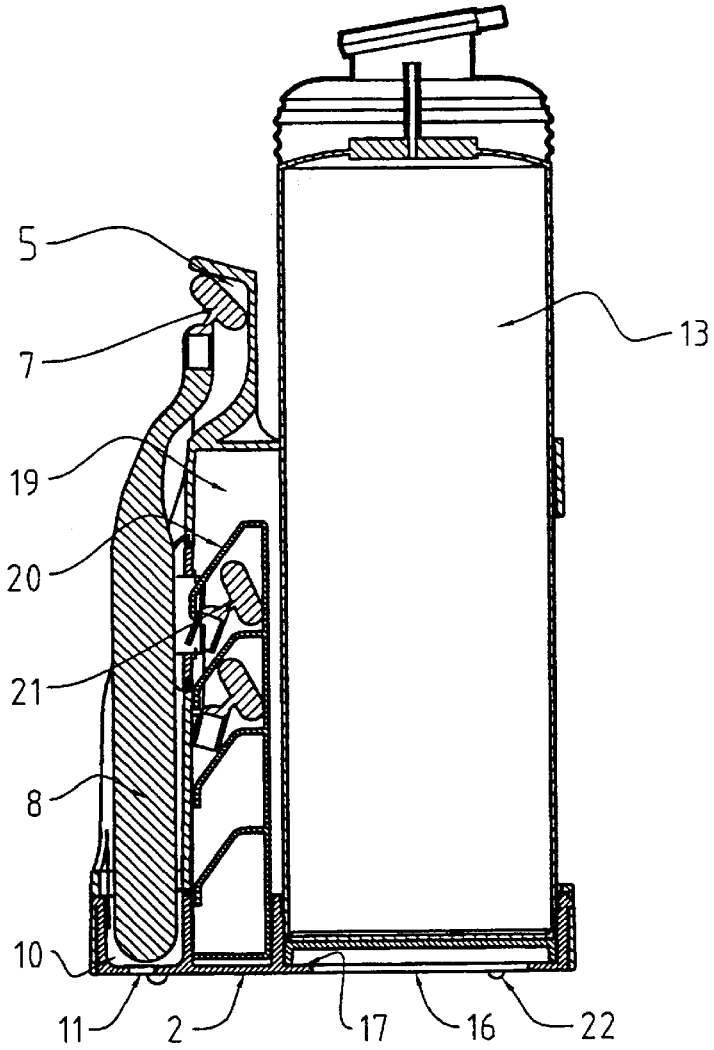
FIG. 3 is an internal side view of the holder of FIG. 1, showing the shaving kit items in place.
Figure 4:
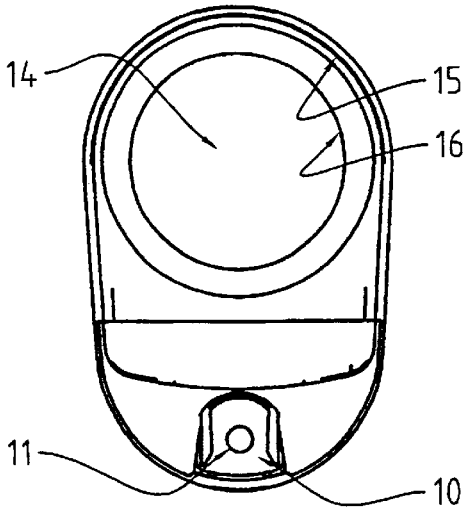
FIG. 4 is a top view of the holder as shown in FIG. 2.
Figure 5:
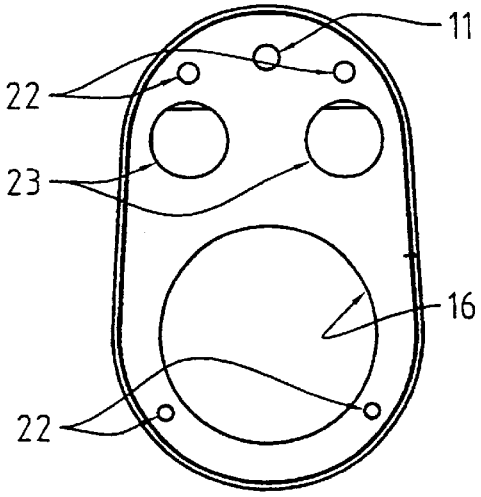
FIG. 5 is an underside view of the holder as shown in FIG. 2.
Figure 6:
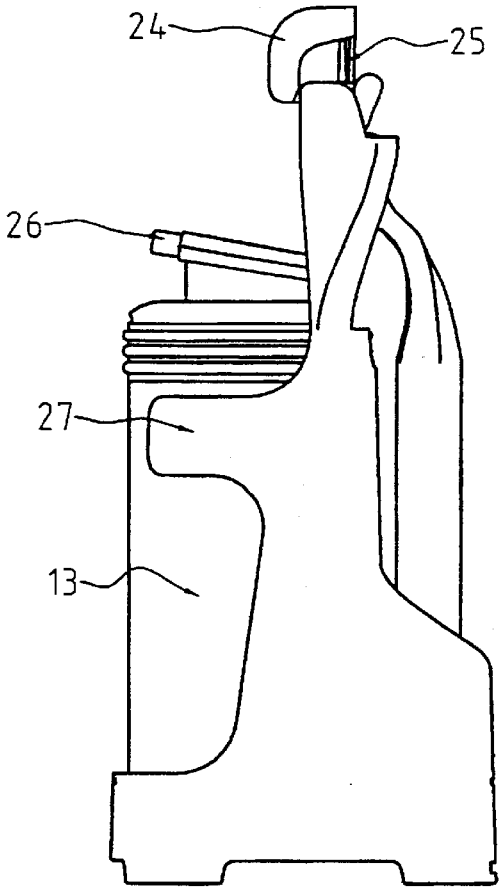
FIG. 6 is a side pictorial view of a shaving kit holder in accordance with a second embodiment of the invention, and showing the holder in use.
Figure 7:
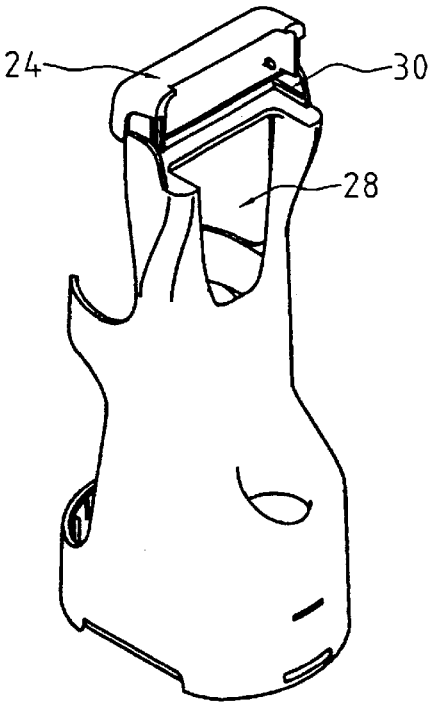
FIG. 7 is one perspective view of the holder of FIG. 6, minus the items of shaving kit.

The razor-receiving section 3 has a generally T-shaped slot comprising a first transverse head-receiving portion 5 at the location of the uppermost portion of the body 1 and a vertical elongate handle-receiving portion 6 below slot portion 5. These slot portions 5, 6 are configured to receive the blade-holding head 7 and the handle 8 of a razor, respectively. In this embodiment, the two slot portions 5, 6 are discontinuous as best seen in FIG. 2. The head-receiving portion 5 provides an upper cavity in which the razor-head is located with the blade(s) facing inwardly and thereby protected from exposure, as best seen in FIG. 3. This ensures user safety and also prolongs the blade life. The handle-receiving portion 6 has one (or more—not shown) resilient clip 9 for retaining the razor handle in the vertical slot. The lower end of slot portion 6 terminates in a lower cavity in the form of a cup-like recess 10 in the base portion 2. The distal end of the razor handle 8 is seated in this cavity 10. At least one drainage hole 11 provides communication between the bottom of the lower cavity 10 and the underside of the base 2 to prevent liquid accumulating in the cavity 10.

The upper cavity 5, retaining clip 9 and lower cavity 10 of the razor-receiving section are preferably all dimensioned and configured to accept some variation in the shape and size of the razor, thereby accommodating more. than one make and model of razor.

The container-receiving section 4 includes an annular upper retaining ring 12 that extends generally horizontally from the support portion of body 1 and defines a circular aperture into which a container, such as an aerosol can 13 of shaving foam or gel, may be inserted. A receiving cavity 14 for the bottom of the container 13 comprises a lower retaining ring 15 in the form of an upstanding circular wall that is formed integrally with the base piece 2. Within wall 15, the base 2 has a circular aperture 16 which is of lesser diameter than the inner diameter of wall 15 to provide a ledge 17 to prevent is the can 13 from sliding through ring 15. This ledge 17 serves to isolate the lower rim of the can 13 from the surface on which the holder is stood. The inner surface of the wall 15 preferably has a set of circumferentially spaced lugs 18. These lugs 18 provide frictional engagement of the bottom of can 13 so that the latter has a push-fit into cavity 14 and does not become accidentally released. The aperture 16 prevents liquid accumulating in the cavity 14.

The body 1 also has an internal compartment space 19, located between the sections 3 and 4, for storing a cassette 20 of blade cartridges 21. The storage space 19 is accessible when the can 13 is removed from section 4, the cassette 20 then being removable by lifting it clear of the internal portion of the lower can-retaining wall 15. The can 13 serves to close off the space 19 and so secure the cassette 20 in position when the can is located in its receiving section 4.

The base portion 2 includes a plurality of feet 22 that are suitably formed as integral moulded projections on the undersurface of base portion 2. The feet 22 serve to define a small gap between the underside of the base and the surface on which it rests. The gap allows circulation of air underneath the holder and so aids evaporation of any liquid that drains through holes 11, 16. The base 2 may include one or more further drainage holes 23, suitably located beneath the cassette storage space 19, for the same purpose.

In use, a razor is carried in slots 5, 6 with its head 7 protectively located in slot 5 and its shaft retained in slot 6 by means of the clip(s) 9. The end of handle 8 is seated in recess 10. The can 13 is passed through upper retaining ring 12 and is located at its base in the cavity 14 defined by wall 15 and ledge 17. The cassette 20 of replacement blade cartridges 21 is protectively stored in the space 19 between the two sections 3, 4.

The second embodiment is similar to the first embodiment so that only the differences will be described in detail. The same reference numerals as used in relation to the first embodiment denote identical or similar parts.

Figure 8:
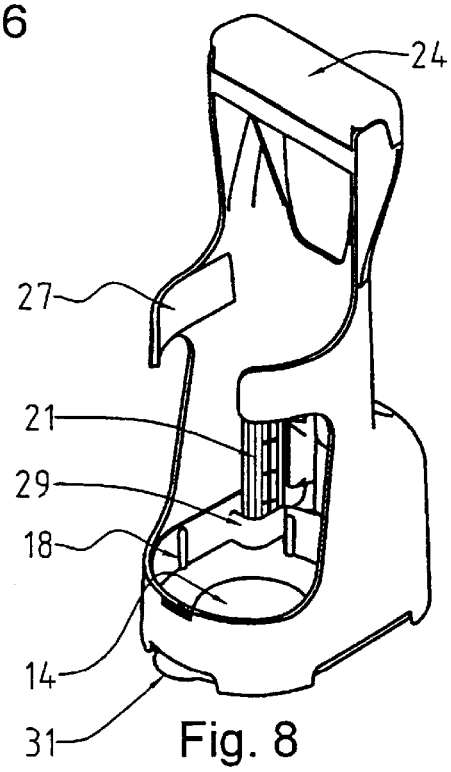
FIG. 8 is another perspective view of the holder of FIG. 6, minus the items of shaving kit.
Figure 9:
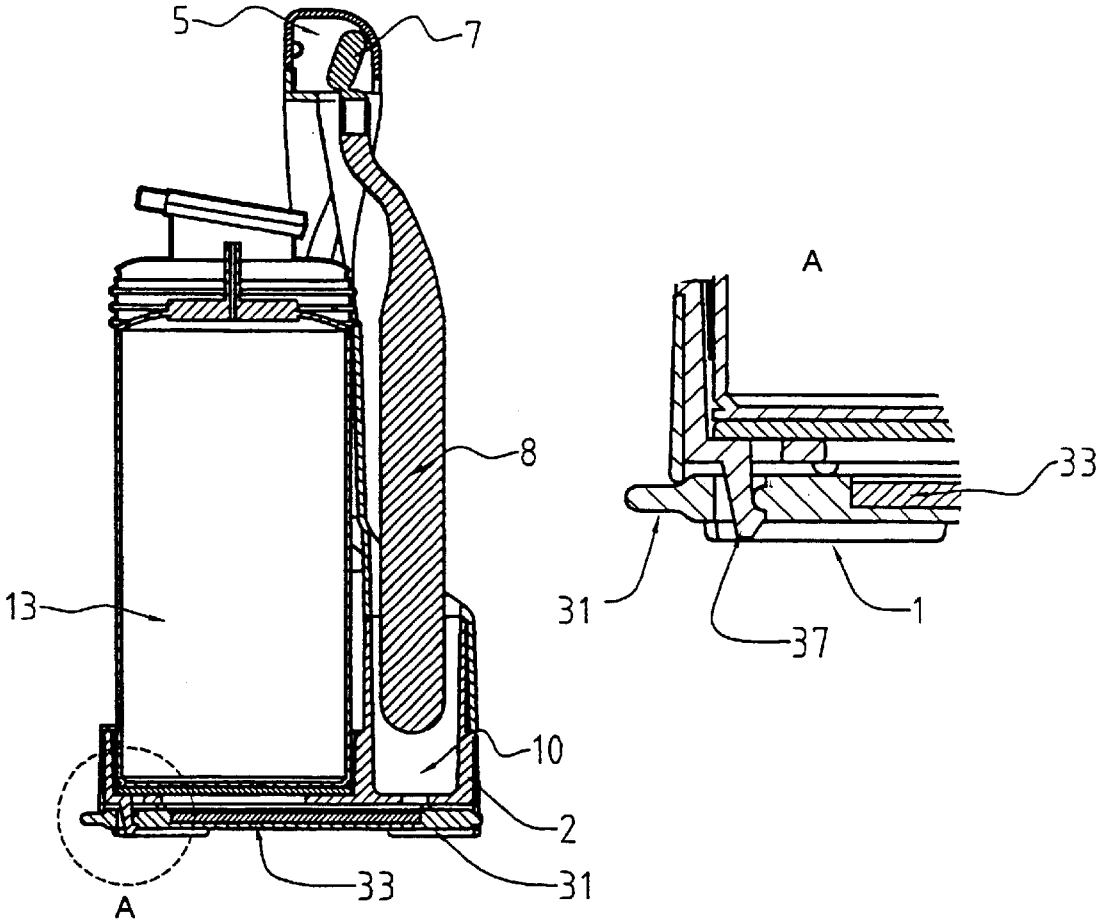
FIG. 9 is an internal side view of the holder of FIG. 6, showing the shaving kit items in place.
Figure 10:
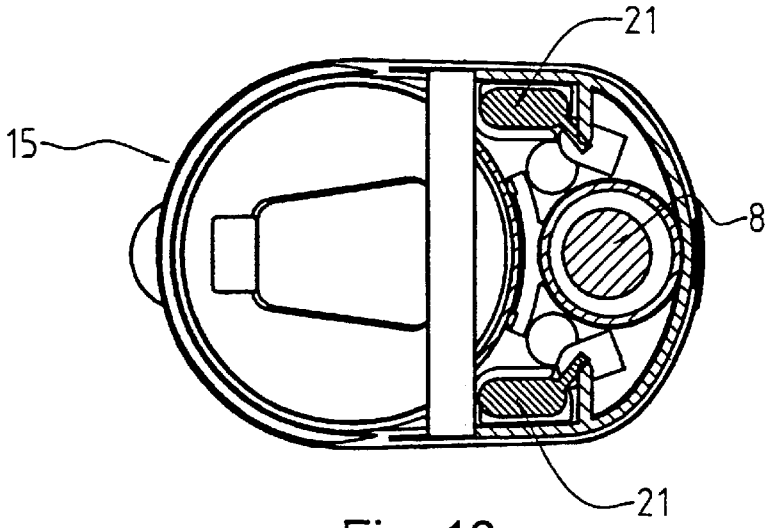
FIG. 10 is an internal plan view of the holder of FIG. 6, showing the shaving kit items in place.
Figure 11:
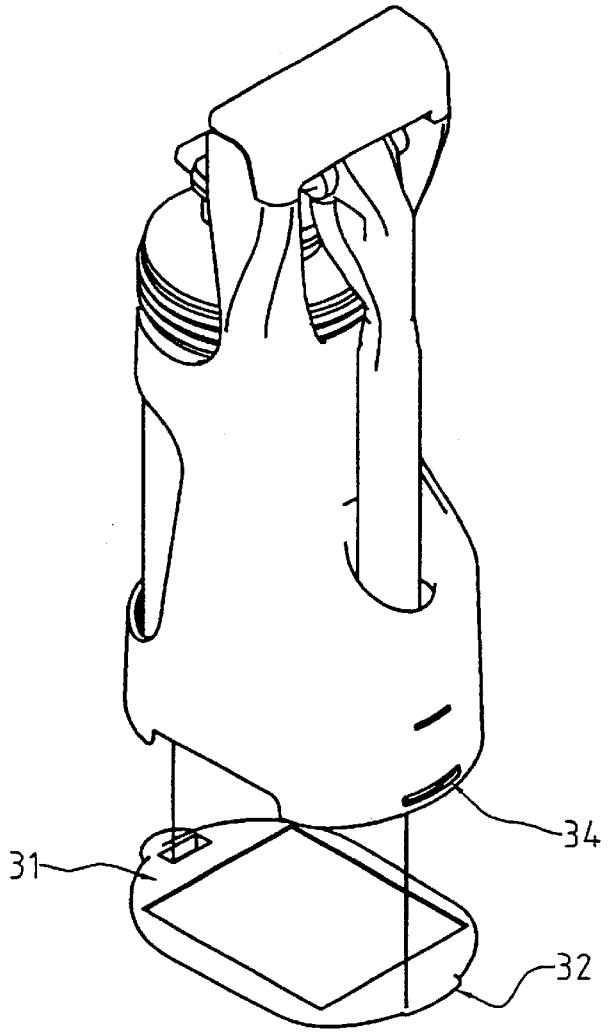
FIG. 11 is a further perspective view of the holder of FIG. 6 inclusive of its detachable mirror.

As shown in FIGS. 6 to 13, the shaving kit holder of the second embodiment includes a movable retaining cover 24 that is hinged at the top of body 1 adjacent the razor head-receiving slot. When in the closed position, as shown in FIGS. 8, 9 and 11, the cover 24 holds the razor securely in place in the receiving section 3 and defines a portion of the cavity 5 in which the razor head 7 is protectively enclosed. The cover 24 also advantageously prevents the razor head 7 from becoming detached from the handle 8, especially during transport. A pair of grooves 25, best seen in FIG. 6, at the outer side walls of the cover 24 engage respective ribs 30 (FIG. 7) in the adjacent sections of the body when the cover is located in the closed position. This arrangement provides a firm snap-lock type of connection. The cover 24 of this embodiment replaces, or alternatively, supplements the retaining clip 9 of the first embodiment.

The upper retaining ring 12 of the first embodiment is open at the front in the present embodiment to provide a pair of engaging arms 27 that embrace the container 13. The arms 27 have a degree of resilience that aids insertion of the container 13 into the space between the arms.

An aperture 28 (see FIG. 7) in the body 1, located beneath the razor head position, permits finger access to the spray button 26 of the aerosol can 13 from the razor section side when the razor is removed for use. This feature enables the can 13 to be used to spray foam or gel without the need to remove the can from the holder.

The internal space of the holder is adapted to accommodate one or more replacement blade cartridges 21. In this embodiment, two such cartridges 21 may be stowed in respective pockets 29 formed integrally with the base 2, as shown in FIGS. 8 and 10. Each pocket 29 includes a low-lying wall that defines a receiving slot into which the cartridge 21 may be inserted and held by way of a push-fit. The spare cartridges 21 are accessible when the can 13 is removed from its receiving section.

A further advantageous feature of this embodiment is the provision of a detachable miniature mirror 31. FIG. 9 shows the mirror attached to the body of the holder and FIG. 11 shows the mirror separated therefrom. The mirror 31, illustrated separately in FIGS. 12 and 13, comprises a moulded plastics frame that surrounds and mounts the mirror piece 33 itself. The outline of the frame has a shape and size such that the mirror 31 fits within the lower wall of the base 2, so that there is a small clearance between the mirror and the support surface on which the base rests. For this purpose, the insertable base piece is located somewhat inwardly with respect to the lower edge of the wall of the holder to define a receiving recess for the mirror.

Figure 12:
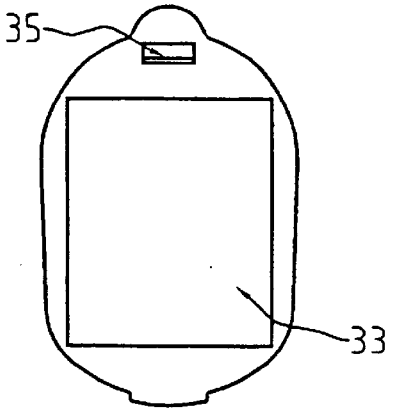
FIGS. 12 and 13 are respectively plan and perspective views of the mirror.
Figure 13:
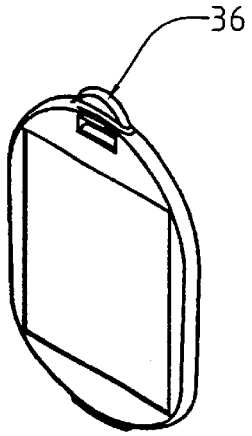

One end of the mirror 31 has a locating tongue 32 (FIG. 11) that is inserted into a receiving slot 34 at the rear of base 2. The other end has a finger-grip portion 36. The front end of the mirror is secured by means of a latch 37 in the base (FIG. 9 detail) that locates in a slot 35 in the mirror (FIG. 12). The mirror is removed for use by manipulating the finger-gip portion 36 to release latch 37 from slot 35, and then pulling the mirror forward slightly to withdraw tongue 32 from slot 34. It will be appreciated that a variety of other simple mechanisms may be employed for attaching the mirror to the body of the holder.

In this embodiment, the mirror fits in the base in a reversible manner. When the mirror faces inwardly, it is protected from damage such as by scratching or breakage during transport. On the other hand, when the mirror faces outwardly it may be used without removal from the holder, which can act as a support for the mirror by laying the holder down on its side.

The shaving kit holder of the embodiments may be manufactured by means of injection moulding, thereby realizing fast and low-cost production with no or minimal manual assembly required. The product may be sold as a separate unit for use with existing items of shaving kit, or as a complete package inclusive of a razor, container of shaving aid substance, and one or more additional blade cartridges, optionally stored in a cassette.

The body of the holder preferably includes a hook, ring, eyelet, suction cap or other suitable means to permit the device to be suspended or attached to a wall or the side of a cupboard as an alternative to being stood on a horizontal surface.

In accordance with the embodiments of the invention, the items of shaving kit are conveniently and safely stored with a lower risk of injury or damage and the container of shaving aid substance can be stood upright without contacting and spoiling the support surface.

The invention may be embodied in numerous forms other than those specifically described herein without departing from the scope thereof. For example, although in the embodiments the base includes a circular well in which the bottom of the container 13 is seated, it is sufficient that the base extend at least partially beneath the bottom of the container to provide the same effect. Furthermore, the lower cavity 10 that receives the end of the razor handle may be omitted or replaced by an additional clip like clip 9. It will also be appreciated that certain features are interchangeable between the two described embodiments.

What is claimed is:

1. A shaving kit holder for holding a kit of items used for wet shaving, said holder comprising a body having a base that allows the holder to be stood on a generally flat surface, said body including a razor-receiving section for holding a razor having a razor head such that the blade or blades of the razor head are protectively located, and said body further including a container-receiving section for holding a container of shaving aid substance in a substantially upright disposition, wherein said container-receiving section includes a portion of said base that extends at least partially under the bottom of said container, and wherein said body includes an internal storage space adapted for storing at least one replacement blade cartridge for said razor, said storage space being closed off by said container when the container is located in said container-receiving section.

2. The shaving kit holder according to claim 1, wherein said internal storage space for stowing a replacement blade cartridge comprises a pocket.

3. The shaving kit holder according to claim 1, wherein said internal storage space accommodates a cassette for holding a plurality of replacement blade cartridges.

4. The shaving kit holder according to claim 1, wherein said razor-receiving section includes a first lower cavity in which one end of the razor handle is seated, and an upper cavity in which the razor head is located.

5. The shaving kit holder according to claim 4, wherein said upper cavity is defined partially by a cover that is movable between an open position permitting insertion and removal of said razor and a closed position in which said razor is locked in said razor-receiving section.

6. The shaving kit holder according to claim 4, wherein said razor-receiving section includes a resilient clip for clamping said razor handle.

7. The shaving kit holder according to claim 1, wherein said container-receiving section includes a second lower cavity defined by an annular wall having an internal ledge for receiving and holding the bottom of said container.

8. The shaving kit holder according to claim 7, wherein said container-receiving section includes an upper retaining ring that supports the body of said container.

9. The shaving kit holder according to claim 1, wherein said body includes an aperture that permits finger access therethrough to a substance release button on said container, whereby the container may be used without removal from said container-receiving section.

10. The shaving kit holder according to claim 1, further including a mirror that is adapted to be removably attached to said body.

11. The shaving kit holder according to claim 8, wherein the upper retaining ring is continuous.

12. The shaving kit holder according to claim 8, wherein the upper retaining ring is open.

* * * * *

UNITED STATES PATENT AND TRADEMARK OFFICE

CERTIFICATE OF CORRECTION

PATENT NO. : 6,598,609 B2
DATED : July 29, 2003
INVENTOR(S) : James Matthews and Irving Gibbs It is certified that error appears in the above-identified patent and that said Letters Patent is hereby corrected as shown below:

Title page,
Item [*] Notice, should read: -- Subject to any disclaimer, the term of this patent is extended or adjusted under 35 U.S.C. 154(b) by 29 days. --

Signed and Sealed this

Eleventh Day of May, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,598,609 B2
DATED : July 29, 2003
INVENTOR(S) : James Matthews Irving Gibbs It is certified that error appears in the above-identified patent and that said Letters Patent is hereby corrected as shown below:

Column 1,
Lines 47-55, delete "surface. [New Paragraph] In a preferred embodiment, the body includes an internal space adapted for storing at least one replacement blade cartridge for the razor, the space being closed off by the container when the container is located in the container-receiving section. This space may accommodate individual cartridges or a cassette in which several cartridges can be stored." and insert the following:

-- surface, and wherein the body includes an internal storage space adapted for storing at least one replacement blade cartridge for the razor, the storage space being closed off by the container when the container is located in the container-receiving section. [New Paragraph] The internal storage space may accommodate individual cartridges or a cassette in which several cartridges can be stored. --.

Column 3,
Line 47, "prevent is the can" should read -- prevent the can --.

Column 5,
Line 7, "finger-gip portion" should read -- finger-grip portion --.

Signed and Sealed this

Eighth Day of June, 2004

JON W. DUDAS
*Acting Director of the United States Patent and Trademark Office*